United States Patent [19]

Virving

[11] Patent Number: 4,772,358

[45] Date of Patent: Sep. 20, 1988

[54] METHOD FOR MAKING PULP

[75] Inventor: Nils G. Virving, Stockholm, Sweden

[73] Assignee: Sunds Defibrator AB, Stockholm, Sweden

[21] Appl. No.: 51,131

[22] Filed: May 18, 1987

Related U.S. Application Data

[62] Division of Ser. No. 711,502, filed as PCT SE84/00221, Jun. 8, 1984, published as WO85/00120, Jan. 17, 1985, abandoned.

[30] Foreign Application Priority Data

Jun. 21, 1983 [SE] Sweden ..... 8303560

[51] Int. Cl.[4] ..... D21B 1/14; B02C 7/12

[52] U.S. Cl. ..... 162/23; 241/28; 241/261.3; 241/297

[58] Field of Search ..... 241/296, 297, 298, 261.2, 241/261.3, 28; 162/28, 23

[56] References Cited

U.S. PATENT DOCUMENTS

| | | | |
|---|---|---|---|
| 3,040,997 | 6/1962 | Borden | 241/296 |
| 3,149,792 | 9/1964 | Textor | 241/298 |
| 3,473,745 | 10/1969 | Shook, Jr. et al. | 241/298 |
| 3,815,834 | 6/1974 | Gilbert | 241/296 |
| 4,039,154 | 8/1977 | Peterson | 241/296 |
| 4,090,672 | 5/1978 | Ahrel | 241/296 |
| 4,163,525 | 8/1979 | Reinhall | 162/47 |

*Primary Examiner*—David L. Lacey
*Assistant Examiner*—K. M. Hastings
*Attorney, Agent, or Firm*—Eric Y. Munson

[57] ABSTRACT

Method and appparatus for making pulp of grinding goods, such as fibre material, in the grinding zone of a grinding apparatus by pressing it against a grinding surface provided with a pattern extending in the direction of movement of the grinding goods over the grinding surface for desintegration of the grinding goods. Steam generated during the grinding work causes a pressure rise along the grinding surface. The region for the maximum pressure in the grinding zone is established with the aid of measurements of the pressure course in the grinding zone and the pattern is formed in a predetermined region around this pressure center so that braking of the grinding goods will be obtained.

2 Claims, 4 Drawing Sheets

METHOD FOR MAKING PULP

This is a division of application Ser. No. 711,502, filed 2-13-85, now abandoned.

FIELD OF THE INVENTION

The present invention relates to a method of making pulp from grinding goods, such as fibre material, in the grinding zone of a grinding apparatus by pressing it against a grinding surface provided with a pattern extending in the direction of movement of the grinding goods over the grinding surface for desintegration of the grinding goods, while the steam generated during the grinding work causes a pressure rise along the grinding surface.

BACKGROUND OF THE INVENTION

When fibre material is ground in e.g. grinding apparatuses of disc type aqueous steam or other vapour is generated during the grinding operation as a result of the high power imposed on the grinding apparatus and thereby a high steam pressure will arise between the grinding segments of the grinding discs. This causes several inconveniences. The steam pressure produces high axial forces, especially at the outer part of the periphery of the grinding discs, which loads the grinding apparatus structure as deposits etc. and also causes bending of the grinding discs so that the grinding segments lose their parallelism. Another disadvantage is the influence of the steam upon the grinding goods, i.e. the fibre material. Thus in the grinding groove the steam pressure generally follows a curve which increases from the inner periphery of the grinding groove to a pressure centre somewhere on the outer half of the grinding discs in order later to sink again towards the outer periphery of the grinding discs. Part of the steam tends to flow back from this pressure centre to the centre of the grinding discs counter current to the direction of movement of the grinding goods, while another part of the steam from the pressure centre rushes outwards towards the outer periphery of the grinding discs while pulling with it the fibre material which thus often leaves the grinding apparatus in insufficiently desintegrated condition.

SUMMARY OF THE INVENTION

In grinding processes such as described above it has been a problem to prevent this exhaust of the pulp without disturbing or affecting the grinding process in other respects and the main object of the present invention is to provide a method and an apparatus for preventing exhaust of the fibre material in insufficiently worked condition. Another object is to provide such a method and apparatus without increase of the load on the grinding surfaces so that the conditions for the grinding process in other respects will not be disturbed.

These and other objects are achieved in that the method and apparatus according to the invention have been given the characteristic features defined in the following claims.

BRIEF DESCRIPTION OF THE DRAWINGS

The invention will be described in more detail below with reference to the accompanying drawings which show embodiments of an apparatus for carrying out the method and in which.

DETAILED DESCRIPTION OF AN EMBODIMENT OF THE INVENTION

Figure 2:
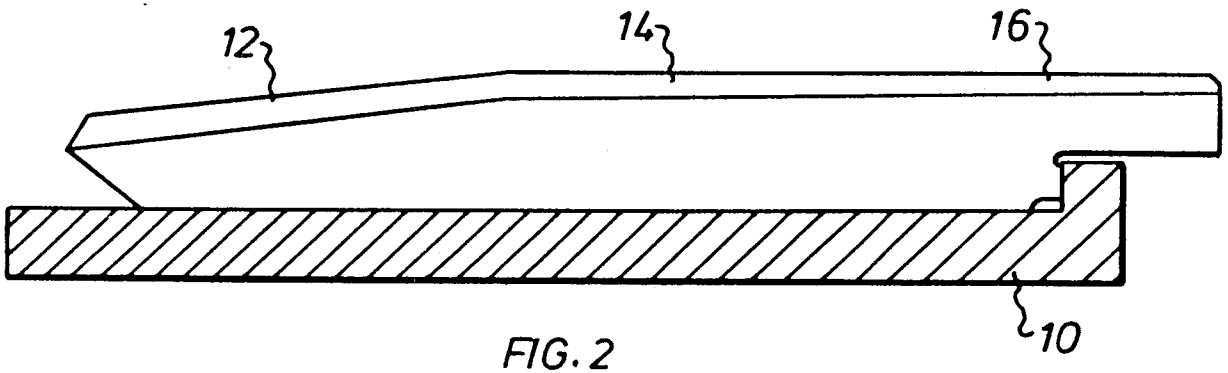

In the drawings the numeral 10 in FIG. 2 designates a supporting plate which may be rotatably or stationarily mounted in a grinding apparatus. The section shown in FIG. 2 is taken radially through the ring-shaped grinding or supporting plate 10 the axis of rotation of which thus lies to the left of the section in FIG. 2. The supporting plate 10 has on one side a grinding segment divided up into three zones 12, 14 and 16 which are provided with patterns and define, together with the grinding segments of an opposed grinding plate (not shown), a grinding groove in which the grinding material is worked during its passage from the inner periphery to the outer periphery of the plate. To enable this working, the grinding segment is provided with a coarse pattern 12 for breaking up the fibre material while the grinding segment in zone 14 has a somewhat finer pattern but still sufficiently coarse for coarse-working of the fibre material and finally in the zone 16 has a still finer pattern for the final fine-working of the fibre material before this leaves the imagined grinding groove at the outer periphery of the supporting plate 10, i.e. the right-hand end in FIG. 2. Of course the number of grinding zones may be greater or lesser than in the embodiment herein described.

Especially in one-stage grinding there is generated, because of the imposed high power, a high steam pressure in the grinding groove by the steam generated from moisture accompanying the fibre material. This causes high axial forces. In order to obtain good pulp quality, low shives content and high forces in the pulp the grinding segments should generally be fine-patterned and contain dams. The size and the fineness of the pattern in especially the outer zone 16 are controlled by the refiner construction which the segment works and are defined practically by the backwardly flowing amount of steam, available axial load and the general stability of the refiner. Thus it is not possible without further measures to provide the grinding segment with a pattern of desired fineness since this would overload the grinding discs and the refiner, alternatively reduce the capacity if the imposed power should decrease.

Figure 1:
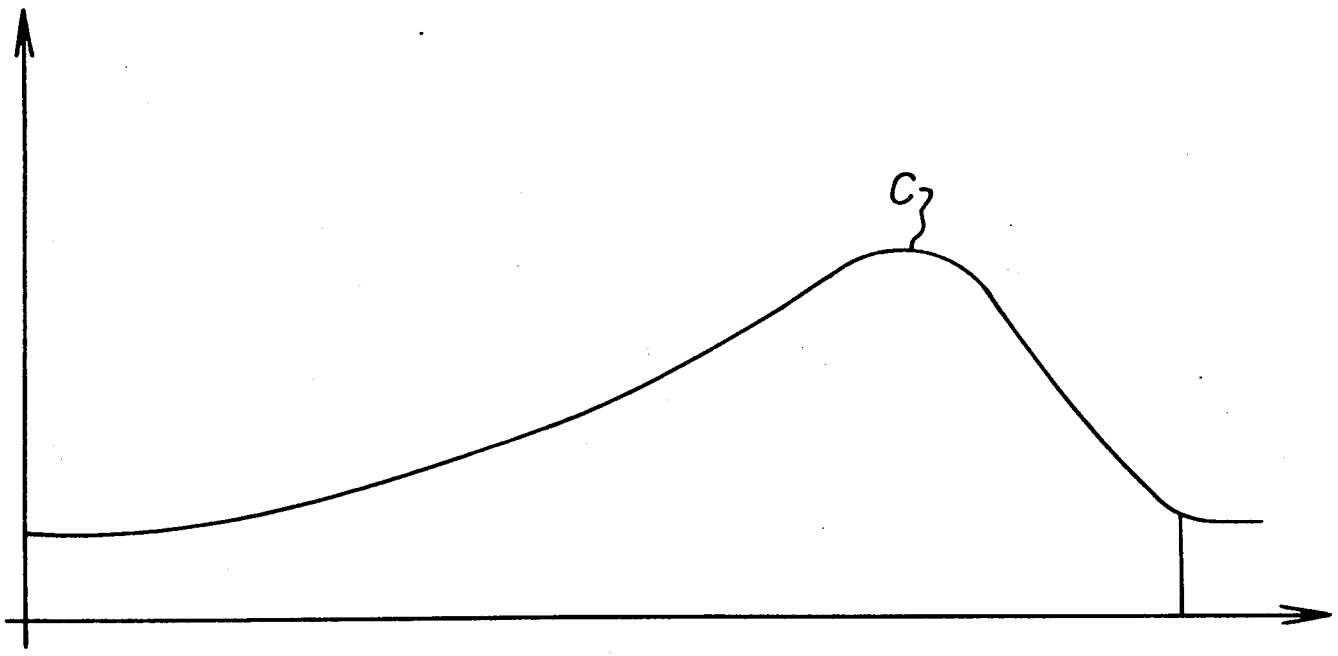
FIG. 1 illustrates an a hypothetical steam pressure curve showing the pressure course over a prior art grinding segment which is represented in section in FIG. 2 in relation to the steam pressure curve in FIG. 1.

Quite generally it has been found that the steam pressure curve in the grinding zones may be assumed to have the appearance represented in FIG. 1, which is related to the grinding plate in FIG. 2. Thus, it was found that the pressure in the grinding groove between the two opposed grinding segments from the zone 12, where the material is broken up and desintegrated, rises steeply during working in the coarse-grinding zone 14 in order finally to attain a maximum pressure somewhere along the grinding segment in the fine-working zone 16 in order thereupon to sink again in the direction of the outlet of the grinding groove, i.e. the outer periphery of the grinding plates 10. Thus the steam pressure curve shows a pressure peak or a pressure centre and it is known that all steam forming inside this pressure centre, which is designated by C in FIG. 1, flows back towards the inlet of the grinding groove while the remaining amount of steam passes in the direction of the outlet of the grinding groove. If therefore the pattern density in the fine zone 16 is high, the steam pressure and the steam velocity increase, which gives a practical limitation of the pattern density that can be used.

According to the invention it has been found that if the approximate location of said pressure centre is established and the pattern of the grinding segments is sealed off, in a limited region around this zone 16, by means of dams or fine patterns then the fibre can be retarded without any appreciable disturbance of the steam flow since the steam velocity in this region is practically nil. The fibre material will thus be retarded by the fine pattern and is not expelled by the steam flow but it will be sufficiently processed before leaving the grinding groove. In order not to disturb the conditions of the grinding process or the steam flow, it is recommended to restrict the fine-patterned zone to a relatively small width on the order of 10 mm to 50 mm, preferably in the order of 20–30 mm. The retardation of the fibre material according to the method of this invention is effected in such a way that the axial load will not increase in any appreciable degree, which is a great advantage with consideration to the stability of the refiner and to make it possible to retain the parallel grinding groove between the grinding plates 10.

Figure 5:
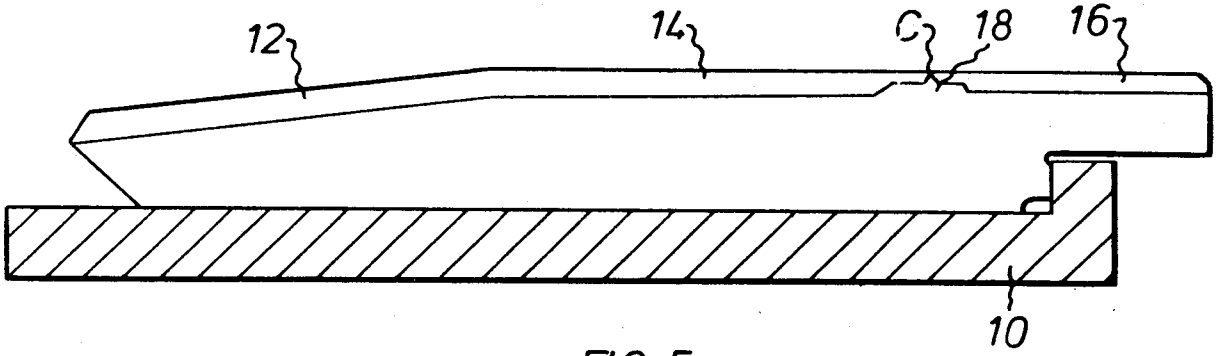
FIG. 5 shows a section through part of the disc in FIG. 4.
Figure 3:
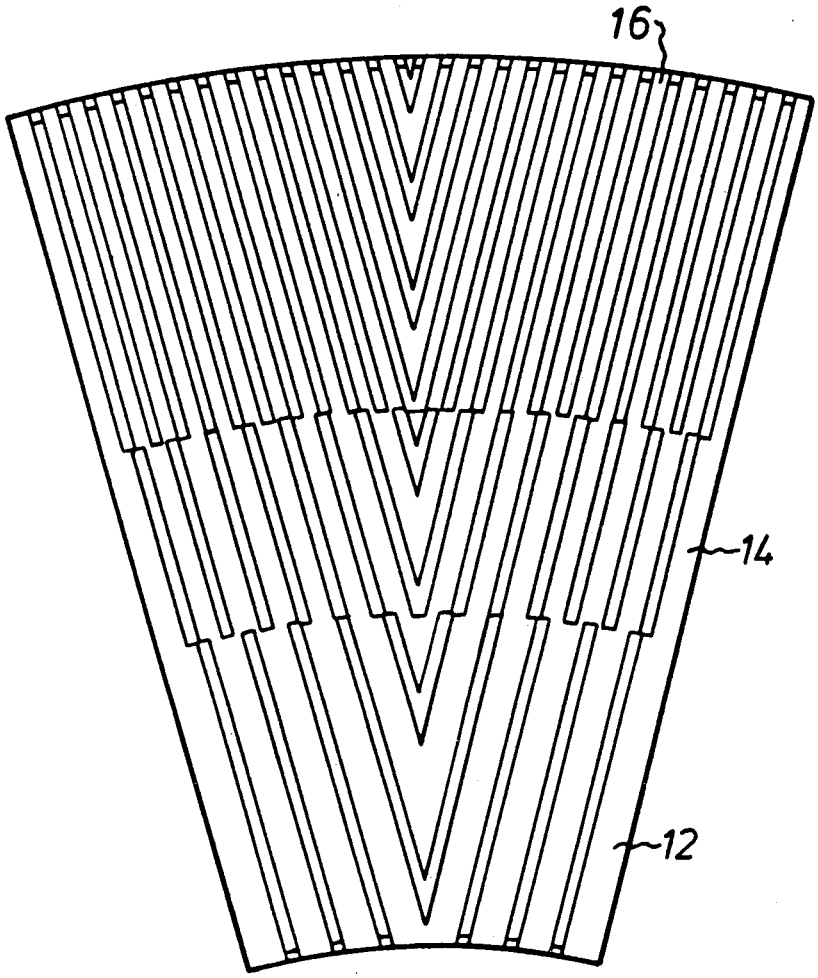
FIG. 3 is a plan view of the prior art segment in FIGS. 1 and 2.
Figure 4:
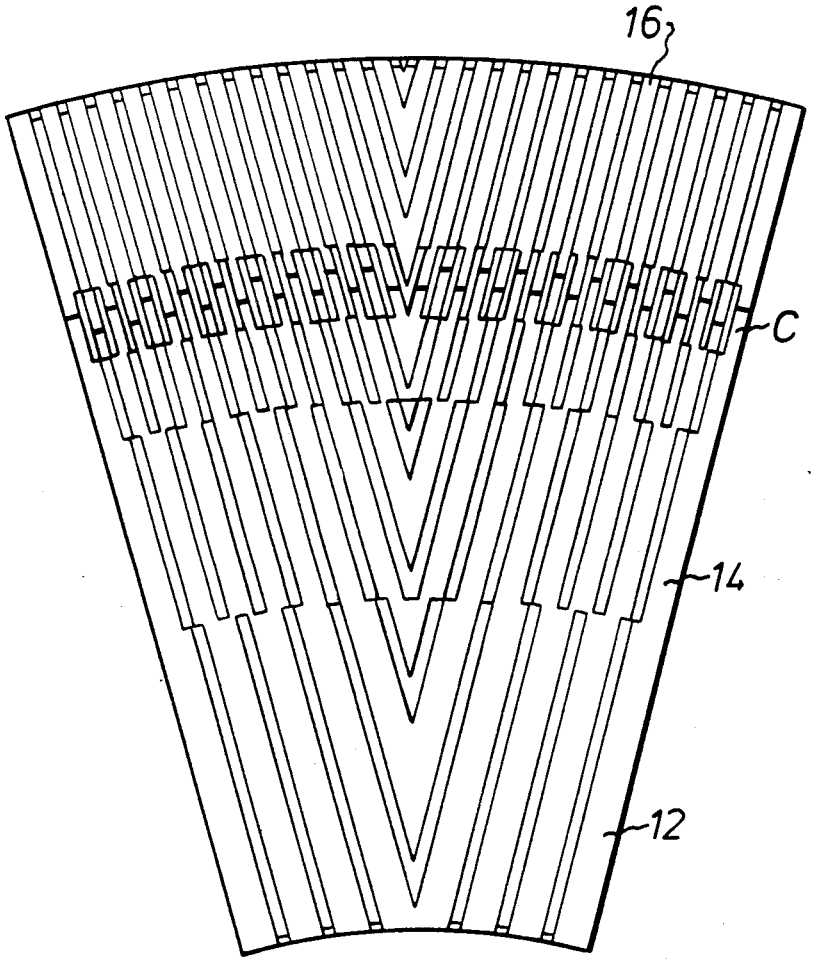
FIG. 4 is a plan view of an embodiment of a grinding segment according to the invention intended for use in a disc type grinding apparatus.

An example of a grinding segment of the new design is shown in FIGS. 4 and 5. It is clear therefrom that, as compared to the conventional grinding segment according to FIG. 3, one has laid in a finer pattern at the position of the pressure centre C, which finer pattern, as appears from FIG. 5, also has dams 18 to effect the desired braking of the material.

We claim:

1. In a method for grinding fibrous, moisture containing pulp material in which the pulp material is ground in a passage extending from a radially inner inlet opening to a radially outer discharge opening, defined between a pair of opposed relatively-rotating grinding members, each of said grinding members comprising at least one grinding plate provided with a grinding pattern including ridges and intervening grooves extending from said inlet opening to said discharge opening in the direction of movement imparted to said pulp material radially outwards through said passage by the effect of the centrifugal force generated by the rotational movement of said grinding members, said movement being accompanies by a flow of steam generated by the heat of friction in said passage during the grinding operation, said flow of steam in said passage increasing in pressure along a curve extending from said inlet opening to a region of maximum steam pressure, the improvement comprising:

(a) determining the region of maximum pressure by measuring the pressure gradient along said passage;

(b) designing grinding pattern in said region of maximum pressure relative to the pattern radially inside and radially outside of said region of maximum steam pressure so as to restain the passage of said pulp material in said region of maximum pressure without disturbing the steam flow and to allow the steam to flow radially inward from said region of measured maximum steam pressure and radially outward from said region of measured maximum steam pressure, said designed pattern having dams located in the grooves in said region of measured maximum steam pressure;

(c) the region of said designed pattern for restraining the passage of pulp material having a radial width of 10 mm. to 50 mm.

2. In a method for grinding fibrous, moisture-containing pulp material in which the pulp material is ground in a passage extending from a radially inner inlet opening to a radially outer discharge opening, defined between a pair of opposed, relatively-rotating grinding members, each of said grinding members comprising at least one grinding plate provided with a grinding pattern including ridges and intervening grooves extending from said inlet opening to said discharge opening in the direction of movement imparted to said pulp material radially outwards through said passage by the effect of the centrifugal force generated by the rotational movement of said grinding members, said movement being accompanied by a flow of steam generated by the heat of friction in said passage during the grinding operation, said flow of steam in said passage increasing in pressure along a curve extending from said inlet opening to a region of maximum steam pressure, the improvement comprising:

(a) determining the region of maximum pressure by measuring the pressure gradient along said passage;

(b) designing the grinding pattern in said region of maximum pressure to be more finely patterned than the pattern radially inside and radially outside of said region of maximum steam pressure so as to restrain the passage of said pulp material in said region of maximum pressure without disturbing the steam flow and to allow the steam to flow radially inward from said region of measured maximum steam pressure and radially outward from said region of measured maximum steam pressure;

(c) the region of said designed pattern for restraining the passage of pulp material having a radial width of 10 mm. to 50 mm.

* * * * *